United States Patent [19]

Nuss

[11] 4,019,475

[45] Apr. 26, 1977

[54] AUTOMOBILE ACCELERATION CONTROL FOR FUEL ECONOMY

[75] Inventor: Christopher Nuss, Warren, Mich.

[73] Assignee: Chrysler Corporation, Highland Park, Mich.

[22] Filed: June 6, 1974

[21] Appl. No.: 477,125

[52] U.S. Cl. ..... 123/103 E; 180/108

[51] Int. Cl.[2] ..... F02D 11/08

[58] Field of Search ..... 123/103 R, 103 E, 103 C, 123/98; 180/108; 340/407

[56] References Cited

UNITED STATES PATENTS

| | | | |
|---|---|---|---|
| 1,833,908 | 12/1931 | Maybach | 123/103 E |
| 2,519,859 | 8/1950 | Teetur | 123/103 E |
| 2,638,082 | 5/1953 | Billard | 123/103 E |
| 2,692,980 | 10/1954 | Platt | 123/103 C |
| 2,817,323 | 12/1957 | Nallinger | 123/103 E |
| 2,825,418 | 3/1958 | Kershman | 123/103 E |
| 3,388,765 | 6/1968 | Sheppard | 180/108 |
| 3,721,309 | 3/1973 | Donaldson | 123/97 R X |
| 3,926,160 | 12/1975 | Husband | 123/103 E |

FOREIGN PATENTS OR APPLICATIONS

| | | | |
|---|---|---|---|
| 751,217 | 10/1933 | France | 180/108 |
| 905,559 | 3/1954 | Germany | 123/103 C |

*Primary Examiner*—C. J. Husar
*Assistant Examiner*—Craig R. Feinberg
*Attorney, Agent, or Firm*—Talburtt & Baldwin

[57] ABSTRACT

Resilient means yieldably opposes opening of the throttle for an automobile engine when the latter is accelerated too rapidly for acceptable fuel economy. Pressure actuated means responsive to inlet manifold pressure withdraws the resilient means from the path of opening movement of the throttle to enable throttle opening without opposition by the resilient means when the rate of acceleration is sufficiently low to achieve the acceptable fuel economy. The throttle opposing force of the resilient means is readily detectable by the automobile driver, but may be overcome by him when rapid acceleration is desired. Also supplemental means under the control of the driver is provided for selectively withdrawing the resilient means from the path of throttle opening movement when no indication of rapid acceleration is desired.

8 Claims, 7 Drawing Figures

AUTOMOBILE ACCELERATION CONTROL FOR FUEL ECONOMY

BACKGROUND AND OBJECTS OF THE INVENTION

With the increasing scarcity of fuel and its rising cost, a number of devices have been proposed to warn an automobile driver when he is accelerating too rapidly for acceptable fuel economy. An example of such a device is a warning sound or light actuated by intake manifold pressure which increases as the rate of acceleration increases. A disadvantage of such a device is that the driver's attention may not be attracted by the warning signal and even if it is, the driver will not known how much to reduce his acceleration in order to avoid excessive fuel consumption. He will thus have to hunt with the pedal in an attempt to synchronize the throttle opening with acceptable economy.

An important object of the present invention is to provide a device for causing a detectable increase in the force required by the driver to depress the customary throttle control pedal when acceleration becomes excessive, which increase in force will be eliminated as soon as the throttle pedal is released sufficiently to effect a predetermined rate of acceleration for acceptable fuel economy.

Other objects are to provide such a device which the driver may readily overpower at his option when rapid acceleration becomes desirable, and which may be selectively rendered inoperative, as for example during expressway driving, so that the driver may accelerate at any rate within the capability of the automobile without experiencing more than customary throttle pedal reaction force.

Another object is to provide such a device responsive to an operating condition of the automobile, as for example the intake manifold pressure, which yieldably opposes throttle opening movement by means of a supplementary spring force when the automobile engine is accelerated at more than a predetermined rate, and which enables return movement of the throttle to its closed position independently of the opposing device in the event the latter should become jammed or stuck.

Other objects are to provide such a device which may be readily calibrated to serve either as a speed limit sensor or as a rate of acceleration sensor and which comprises a spring urged member in the path of opening movement of the throttle to oppose such movement, in combination with pressure actuated means responsive to an operating condition of the automobile, such as inlet manifold pressure, for withdrawing the spring urged member from said path during idle or steady state operation and low rate acceleration suitable for city driving for example with acceptable fuel economy.

Other objects of this invention will appear in the following description and appended claims, reference being had to the accompanying drawings forming a part of this specification wherein like reference characters designate corresponding parts in the several views.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
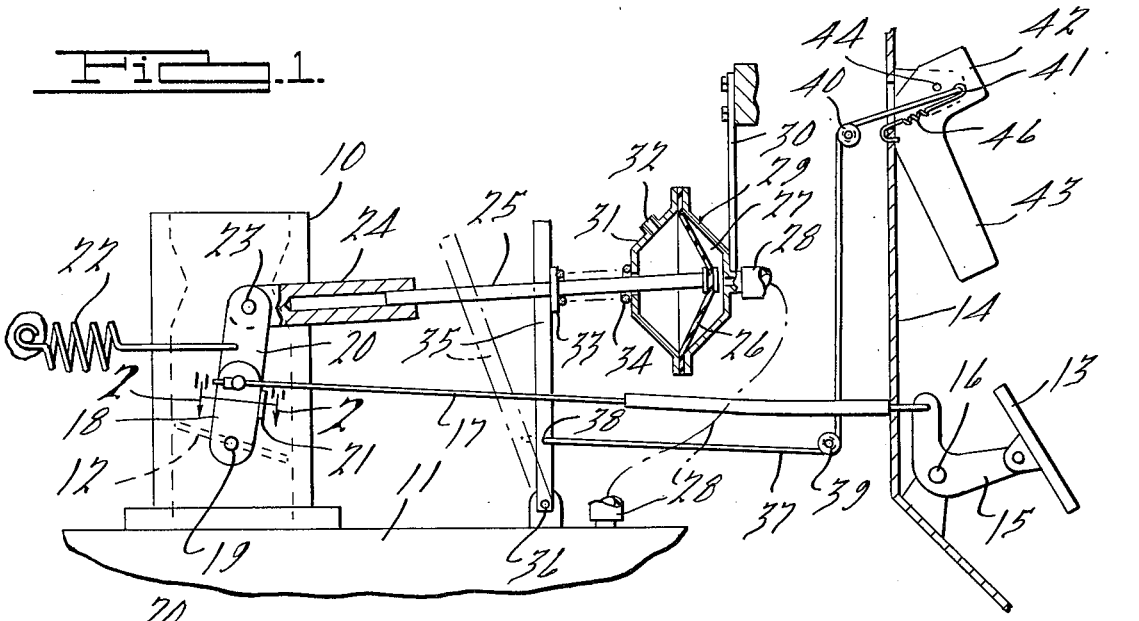
FIG. 1 is a fragmentary schematic longitudinal section through a portion of an automobile body, illustrating an embodiment of the present invention in its deactivated position.
Figure 2:
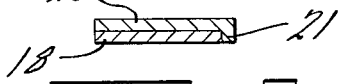
FIG. 2 is a fragmentary section taken in the direction of the arrows substantially along the line 2—2 of FIG. 1.
Figure 3:
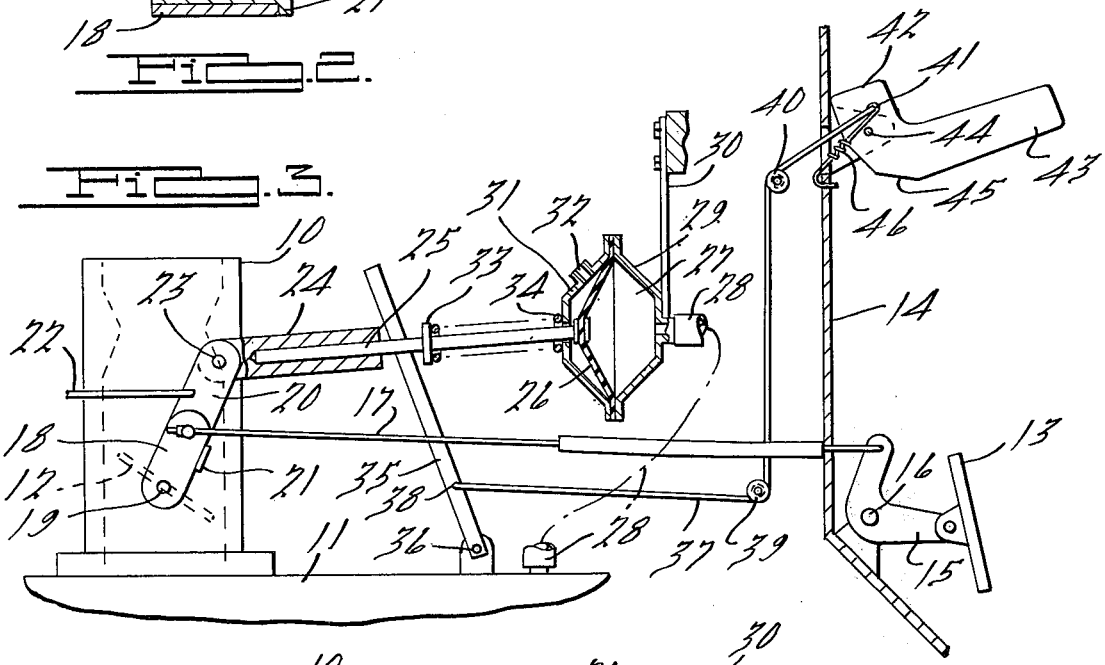
FIG. 3 is a view similar to FIG. 1, showing the device in position during acceleration that is too rapid for acceptable fuel economy.

Referring to the drawings and particularly to FIGS. 1, 2 and 3, a portion of an automobile is illustrated having a conventional carburetor 10 for supplying a fuel-air mixture to the inlet manifold 11 in communication with the engine cylinders. A conventional butterfly type throttle valve 12 is pivotally mounted within the inlet induction conduit of the carburetor 10 and is operated in a conventional manner by a pedal 13 within the vehicle body or passenger compartment of the automobile. The pedal 13 is pivotally supported on one arm of a bell crank 15 which in turn is pivoted at 16 on a fixed support or firewall 14 of the body. The other arm of the crank 15 is connected to one end of a throttle control cable 17 having its opposite end secured to the radially outer end of a crank arm 18 keyed to the pivot shaft 19 of the throttle 12 to operate the latter in accordance with customary operation of the pedal 13. It is apparent that upon depression of the pedal 13, the member 15 will pivot clockwise about its pivot 16 to actuate the cable 17 to swing the crank arm 18 and throttle valve 12 clockwise in an opening direction.

A swinging link 20 freely pivotal on the shaft 19 coaxially with the throttle 12, but independently thereof, is provided with a flange 21, FIG. 2, that overlies the crank arm 18. When the latter swings clockwise in the throtle valve opening direction, it will engage flange 21 and swing the lever 20 clockwise. Counter-clockwise return movement of the throttle operating arm 18 to the closed position will be independent of the swinging lever 20 in the event that the latter should become stuck. A light return spring 22 connected between a fixed portion of the vehicle and the arm 20 urges the latter in the counter-clockwise direction upon closing movement of the crank arm 18 and throttle 12.

The radially outer end of the lever 20 is pivotally connected at 23 to the base of a cylinder member 24 having a central rightwardly opening bore within which one end of a plunger 25 is freely reciprocable. The opposite end of plunger 25 is secured to a flexible diaphragm 26 comprising a movable wall of a pressure chamber 27. The latter is connected by conduit 28 with the inlet manifold 11 for operation in accordance with manifold pressure as described below. A fixed wall 29 of the chamber 27 is secured to a fixed portion 30 of the vechile body.

The plunger 25 extends from the diaphragm 26 through a fixed guide wall 31 associated with the diaphragm 26 and vented to the atmosphere at 32 to enable movement of diaphragm 26 freely in response to pressure changes within the manifold 11. It is apparent that decreasing pressure within the manifold 11 urges diaphragm 26 to the right, as for example to the position shown in FIG. 1 which may correspond to an idle or steady state operating condition of the automobile engine or to a position of low rate acceleration to achieve acceptable fuel economy.

A spring retainer 33 is secured to the shaft 25 at a suitable location exteriorly of the wall 31 to retain one end of a coil spring 34 under compression between the retainer 33 and the wall 31 coaxially around plunger 25. If the driver of the automobile should depress the foot pedal 13 in an attempt to accelerate at a rate greater than permissible for a predetermined acceptable fuel eonomy, the pressure in manifold 11 will rise and spring 34 acting against retainer 33 will move plunger 25 leftward to the bottom of the bore of member 24. In consequence, the driver will detect a sudden increase in the force required to depress the foot pedal 13 sufficiently to maintain his rate of acceleration and he will be immediately alerted to the fact that his acceleration is at the expense of fuel economy.

If the driver deems the high rate of acceleration desirable for any reason, as for example to facilitate passing another vehicle, he may exert the additional pressure on the pedal 13 required to override the force of spring 34 and may accelerate to the maximum capability of his automobile. On the other hand, if his rate of acceleration was the result of carelessness and was not desired, he will ease the pressure on the pedal 13 to permit closing of the throttle 12 and a resumption of the low intake manifold pressure required in chamber 27 to move the diaphragm 26 rightward and withdraw the plunger 25 from the bottom of the bore of member 24.

The area of the diaphragm 26 and resiliency of the spring 34 are selected in accordance with the geometry of the structure described, so that plunger 25 will bottom within member 24 at a predetermined pressure within inlet manifold 11 corresponding for example to a rate of acceleration that is excessive for a predetermined fuel economy. With such a calibration, during idle operation or steady state cruising at speeds that could be as high as 70 or 80 miles per hour, depending on the automobile, the diaphragm 26 will be retracted toward the FIG. 1 position and plunger 25 will be withdrawn from engagement with the bottom of cylinder 24. However if desired, the device could also be calibrated for use as a speed sensor, whereby plunger 25 would then bottom within member 24 at a preselected limiting speed, as for example at 55 or 60 miles per hour, and thus oppose throttle opening at speeds in excess of the preselected limiting speed.

In order to disable the above described alerting device, as for example during expressway driving conditions when it might be desirable to prevent spring 34 from opposing throttle opening at any time, a disabling lever 35 is pivotally mounted on a fixed portion of the vehicle at 36 to engage and prevent leftward movement of the spring retainer 33 from the position shown in FIG. 1. At this position, opening movement of the throttle 12 will then not be opposed by the plunger 25.

The lever 35 is maintained in the disabling position by a cable 37 attached at 38 to a lower portion of the lever 35 and suitably guided through an aperture in the firewall 14 by means of pulleys 39 and 40. The cable 37 is secured at 41 to a short arm 42 of an overcenter lever 43. The latter is pivotally mounted at 44 on a fixed portion of the wall 14 such that when the lever 43 is in the disabling position shown, FIG. 1, a flat 45 of the lever 43 will rest flush against the wall 14 and the force of spring 34 urged against lever 35 and directed via cable 37 to the lever 43 at 41 will urge the latter clockwise and hold the flat 45 firmly seated at the position shown in FIG. 1.

Upon manual operation of the lever 43 to swing the latter counter-clockwise to the position shown in FIG. 3, the connection 41 between the cable 37 and arm 42 will be moved upwardly above the pivot 44 and maintain the lever 43 at the ON or active position shown in FIG. 3. A light-weight overcenter spring 46 may be connected between the wall 14 and lever 43 adjacent the point 41 to maintain the lever 43 at the FIG. 3 position in the event the pressure of inlet manifold 11 causes withdrawal of the spring retainer 33 rightward out of engagement with the lever 35. When the lever 43 is moved to the FIG. 1 disabling position, the point of attachment 41 for the overcenter spring 46 will be moved below the pivot 44 in position to cooperate with spring 34 and maintain the lever 43 in the FIG. 1 position.

Figure 4:
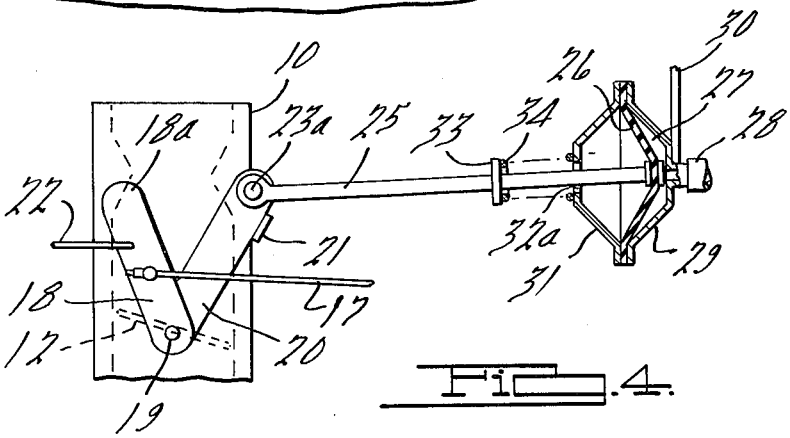
FIG. 4 is a view similar to FIG. 1, showing another embodiment of the present invention.

FIG. 4 illustrates a modification of the present invention comprising the general concept described above, wherein corresponding parts function in the manner described above and are correspondingly numbered. A vent 32*a* in wall 31 also provides passage for the plunger 25 which is pivotally secured at 23*a* directly to the upper swinging end of the lever 20. The flange or projection 21 of lever 20 is located adjacent the radially outer end of lever 20 and engages a radial extension 18*a* of the crank arm 18 to engage the latter upon clockwise opening movement of throttle valve 12 when the inlet manifold pressure conducted via 28 to diaphragm 26 is sufficiently high to enable leftward spring-urged movement of plunger 25 and counterclockwise swinging of lever 20 as urged by the spring 34. The FIG. 4 construction provides increased leverage for spring 34, enabling a spring 34 of lighter weight than required in the FIG. 1 embodiment.

When the engine is operating at idle or steady state cruising, the low pressure conducted to pressure actuated diaphragm 26 from the inlet manifold 11 (illustrated in FIG. 1) via conduit 28 to chamber 27 causes rightward movement of diaphragm 26 and compression of spring 34 approximately to the position shown in FIG. 4. Lever 20 and flange 21 are thus moved out of engagement with lever 18*a* to enable opening of throttle 12 without opposition from spring 34.

In the event the engine is accelerated too rapidly for acceptable fuel economy, the excessive opening of throttle valve 12 will cause an immediate rise in the inlet manifold pressure, enabling spring 34 to move lever 20 and flange 21 counterclockwise into engagement with the lever extension 18*a*. The driver will then detect the additional force effected by spring 34 and required to maintain the throttle 12 in the excessively open position. He will have the option of easing his pressure on the accelerator pedal 13 to return to a more economical rate of accelertion as far as fuel is concerned, or he may override the additional pressure exerted by spring 34 and continue the rapid acceleration, as described above.

Figure 5:
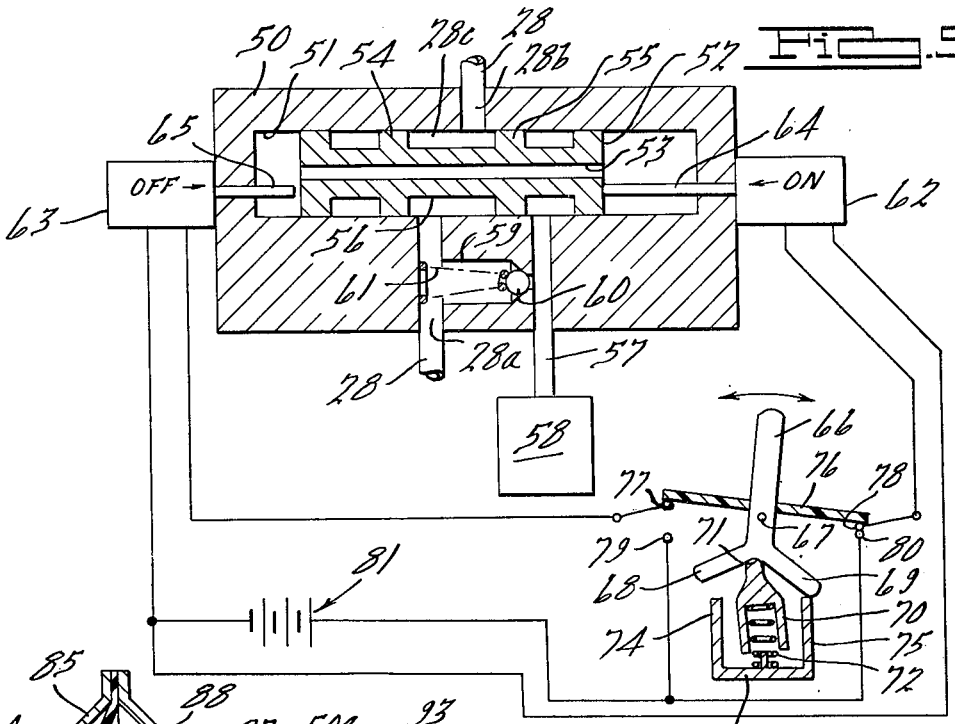
FIGS. 5, 6 and 7 are also views similar to FIG. 1, showing still other embodiments of the invention.
Figure 6:
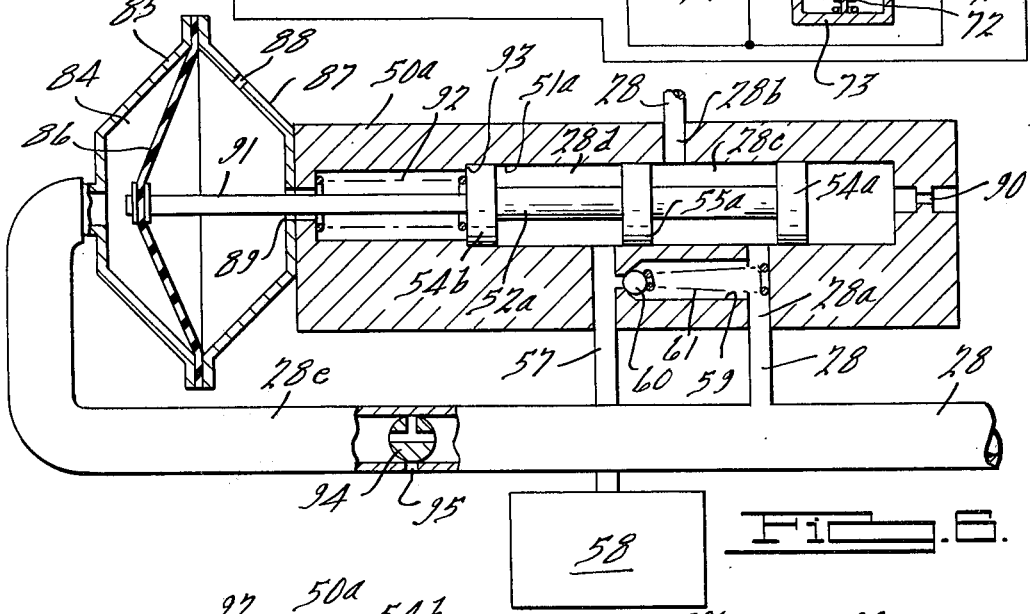
Figure 7:
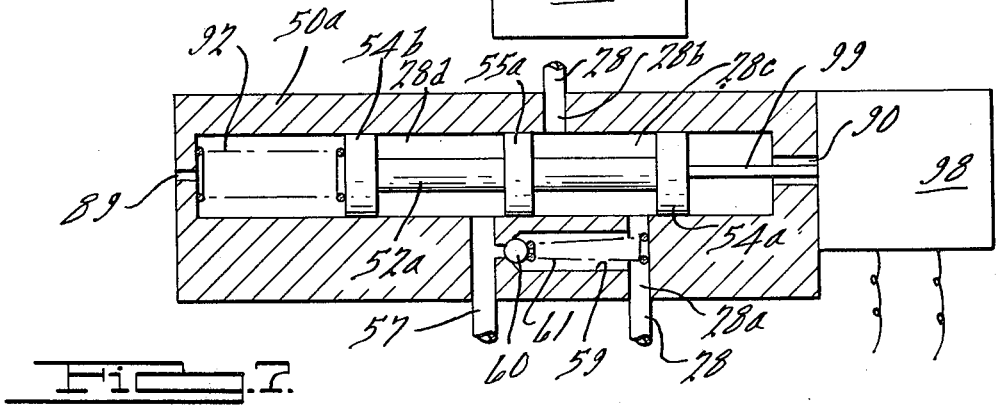

FIGS. 5, 6 and 7 show modification of the invention adapted for use with the throttle opposing structure of either FIG. 1 or FIG. 4, wherein a control valve is provided in the conduit 28 between the intake manifold 11 and pressure actuated diaphragm 26. The control valve may be actuated manually and directly or by other means as described below. In other respects the structure and operation of the invention is the same as described above in regard to FIGS. 1 and 4 and corresponding parts are numbered the same.

In FIG. 5, the valve in conduit 28 comprises a housing 50 having a cylindrical bore 51 for a slidable spool valve 52. The latter has an axial bore 53 for equalizing the pressure at its opposite ends within the chamber 51. The housing 50 has an inlet 28*a* in communication via conduit 28 with the inlet manifold 11 as illustrated in FIG. 1, and an outlet 28*b* in communication via conduit 28 with the pressure actuated diaphragm 26. The spool valve 52 has a pair of axially spaced lands 54 and 55 spaced axially by a centrally reduced portion 56 which effects an annular chamber 28*c* comprising part of the conduit 28 when the spool valve 52 is at the ON or operative position illustrated in FIG. 5. Thus a direct connection between inlet manifold 11 and chamber 27 is effective to operate diaphragm 26 as described in regard to either FIG. 1 or 4.

Opening into chamber 51 immediately to the right of land 55 when the spool valve 52 is at the position shown in FIG. 5 is a conduit 57 in communication with a vacuum accumulator 58. The conduit 57 is also in one way communication with the inlet 28*a* and the inlet manifold 11 via conduit 59 having a one-way spherical check valve element 60 seated therein and normally held in the closed position by means of a light weight spring 61 as illustrated. Accordingly, when the inlet manifold pressure is less than the pressure within accumulator 58, air will flow from accumulator 58 into conduit 59 via check valve 60, which will open against the light tension of the spring 61, until the pressure in accumulator 58 drops to substantially the inlet manifold pressure. When the inlet manifold pressure at 28*a* is greater than the pressure within accumulator 58, check valve 60 will seat within conduit 59 and prevent return flow of air into the accumulator 58. Thus the latter will be evacuated whenever the engine is operating at the idle or steady state cruising condition. Once evacuated, the low pressure will be retained in the accumulator 58.

Upon rightward movement of the slide valve or spool valve 52 to an inoperative position, the land 55 will be moved rightward of the opening of conduit 57 into chamber 51, and land 54 will be moved rightward of the inlet 28*a* into chamber 51, but will remain leftward of outlet 28*b*. At this position, the outlet 28*b* will be disconnected from the inlet 28*a* and diaphragm 26 will no longer be responsive to the inlet manifold pressure. The vacuum within accumulator 58 however will be conducted via conduit 57, chamber 28*c*, and outlet 28*b* to the chamber 27, thereby to maintain diaphragm 26 at the rightward inoperative position substantially as illustrated in both FIGS. 1 and 4. Thus, regardless whether the plunger 25 and cylinder 24 type of arrangement illustrated in FIG. 1 or the direct connection between plunger 25 and lever 20 illustrated in FIG. 4 is employed to oppose opening of the throttle valve when the slide valve 52 is at the operative position shown in FIG. 5, the throttle valve 12 may be opened without opposition from spring 34 when the slide valve 52 is shifted rightward to the inoperative position described above.

The position of the spool valve 52 is determined by the operation of electrical ON and OFF solenoids 62 and 63 respectively associated with the right and left ends of housing 50. Upon energizing solenoid 62, solenoid operated plunger 64 is shifted leftward to move the valve 52 to the operating position illustrated in FIG. 5. Upon energizing solenoid 63, solenoid operated plunger 65 is moved rightward in FIG. 5 to move the spool valve 52 rightward to the OFF or inoperative position described above.

The solenoids 62 and 63 are selectively energized at the discretion of the automobile driver by means of a switch 66 pivotally mounted at 67 on a fixed portion of the vehicle. The switch 66 comprises an inverted Y having arms 68 and 69 extending angularly from each other in opposite directions from its lower end. An overcenter type spring retainer 70 has an upper spherical element 71 maintained in seated position at the angular juncture of the arm 68 and 69 by means of a light-weight spring 72 suitably retained under tension between the element 70 and a fixed support 73. The latter also provides movement limiting arms 74 and 75 engageable with the ends of the arms 68 and 69 respectively to limit pivoting of the switch 66 about its pivot 67.

The switch 66 carries an integral dielectric cross bar 76 having electrical contacts 77 and 78 at its opposite ends in position to make electrical connections with contacts 79 and 80 respectively upon counterclockwise or clockwise pivoting of switch 66 to its OFF or ON positions respectively. Upon clockwise pivoting of switch 66 to the ON position illustrated in FIG. 5, contacts 78 and 80 are electrically connected to complete an operative electrical circuit and energize the ON solenoid 62 by means of power source 81, thereby to shift the plunger 64 and slide valve 52 leftward to the ON position illustrated in FIG. 5. At this position the spherical element 71 of the overcenter spring retainer 70 will still be maintained at the angular juncture of arms 68 and 69, but will bear primarily against arm 68 to maintain switch 66 at the ON position.

Similarily, upon counterclockwise pivoting of switch 66 to the OFF position, contacts 77 and 79 will be connected to complete an operative electrical circuit through solenoid 63 and power source 81, thereby to energize solenoid 63 to shift plunger 65 and slide valve 52 rightward to the OFF position. The sperhical element 71 will then have been moved overcenter with respect to the juncture between the arms 68 and 69 so as to bear primarily against the latter arm and yieldingly hold the switch 66 in the OFF position.

FIG. 6 illustrates a modification comprising a valve housing 50*a* having a central cylindrical valve chamber 51*a* for spool valve 52*a*. The latter is provided with lands 54*a* and 54*b* at its opposite ends and an intermediate land 55*a* spaced from land 54*a* by a reduced valve portion to provide annular chamber 28*c*, and spaced from land 54*b* by a reduced valve portion to provide an annular chamber 28*d*. Valve 52*a* is illustrated in the ON position whereat valve inlet 28*a* and outlet 28*b* are in communication via chamber 28*c*, thereby to provide a direct communication between the inlet manifold 11 and pressure chamber 27 as described. Upon rightward shifting of spool valve 52*a* to the OFF or inoperative position, land 55*a* will be shifted rightward of outlet 28*b* to connect the latter outlet with conduit 57 and vacuum accumulator 58 via annular chamber 28*d*. At this position the vacuum of tank 58 will be applied directly to the chamber 27 and diaphragm 26 to hold the latter at the rightward inoperative position substantially as illustrated in FIGS. 1 and 4.

In FIG. 6, conduit 28 has an extension 28*e* in communication with a pressure chamber 84 defined by a fixed housing 85 and a flexible diaphragm 86. The housing 85 is secured to a fixed portion 87 secured adjacent the left end of the valve housing 50*a* and vented to atmosphere at 88. The opposite ends of valve housing 50*a* are vented to atmosphere at 89 and 90, vent 89 also providing passage for a valve operating plunger 91 secured at its opposite ends to diaphragm 86 and the left end of spool valve 52*a* to actuate the latter. A comparatively light-weight biasing spring 92 between the left ends of valve housing 50*a* and spool valve 52*a* normally urges the latter rightward to the OFF position. Leftward movement of the valve 52*a* against the tension of spring 92 is limited by a radially inward annular shoulder 93 of the housing 50*a*. A manually operated two-position valve 94 in the conduit extension 28*e* is shown at the ON or operative position for connecting pressure chamber 84 directly with the inlet manifold 11 via conduit 28. Upon rotation of valve 94 counterclockwise 90° from the position shown, chamber 84 will be disconnected from conduit 28 and vented to atmosphere via port 95. At this position, the atmospheric pressure in chamber 84 enables spring 92 to urge spool valve 52*a* rightward to the OFF position.

In accordance with the structure of FIG. 6, when the valve 94 is at the position shown, any small inlet manifold vacuum will be adequate to move diaphragm 86 leftward against the light force of spring 92, even though this same vacuum is inadequate to move diaphragm 26 rightward against the stronger force of spring 34. With the diaphragm 86 at the leftward operative position illustrated, the accumulator or vacuum tank 58 will be evacuated as described above whenever the inlet manifold pressure is less than that within the tank 58. Also the inlet manifold pressure conducted via conduit 28, 28*a*, 28*c*, and 28*b*, to chamber 27 will operate diaphragm 26 as described above.

When valve 94 is rotated 90° counterclockwise to vent chamber 84 to atmosphere via port 95, the light spring 92 will then urge spool valve 52*a* to the OFF or inoperative position, whereby vacuum tank 58 is connected directly with chamber 27 via conduit 57, annular chamber 28*d*, and outlet 28*b* to move diaphragm 26 and spring retainer rightward and thus enable opening of throttle valve 12 without opposition from spring 34.

FIG. 7 illustrates another embodiment of the invention similar to that illustrated in FIG. 6 wherein the pressure actuated diaphragm 86 is eliminated and its function is provided by an electrical solenoid 98 having solenoid actuated plunger 99 extending through bleed port 90 and arranged to move slide valve 52*a* leftward against the light tension of spring 92 when the solenoid 98 is suitably actuated to an ON condition. Upon actuation of the solenoid 98 to an OFF condition, plunger 98 will either be retracted rightward or will be released for rightward movement, whereby valve spool 52*a* will be shifted rightward via the spring 92 to the OFF position as described above in regard to FIG. 6. In all other respects, the structure and operation of FIG. 7 is the same as that of FIG. 6 and corresponding parts are numbered accordingly.

Having thus described my invention, I claim;

1. In a device for an automobile having a fuel and air inlet manifold and also having driver controlled throttle means for controlling the inlet flow in said manifold, means for alerting the automobile driver when the throttle means is opened too rapidly for acceptable fuel economy comprising the combination of yieldable means for opposing opening movement of said throttle means with a force detectable by said driver and being yieldable upon the application of additional throttle opening force by said driver to enable opening of said throttle means against said detectable force, and means for operatively connecting said manifold and throttle means and cooperable with said yieldable means for operating the latter to enable opening movement of said throttle means unopposed by said detectable force when the pressure in said manifold is less than a predetermined value corresponding to the extent of opening of said throttle means, said means for connecting comprising a pair of members arranged for movement in directions toward and from positions of throttle resisting relationship with respect to each other, means independent of said pressure for connecting said throttle means with one of said members for moving the latter in the directions toward and from said throttle resisting relationship in unison with opening and closing respectively of said throttle means, and reciprocating means responsive to said pressure and cooperable with the other of said members for urging the latter in the direction from said throttle resisting relationship whenever said pressure is less than said predetermined value, said yieldable means comprising means cooperable with said other member and reciprocating means for yieldingly opposing the pressure responsive operation of the latter urging said other member in the direction from said throttle resisting relationship and also for yieldingly urging said other member in the direction toward said throttle resisting relationship regardless of said pressure.

2. In the combination according to claim 1, means selectively operable independently of said manifold inlet flow for operating said yieldable means to enable said unopposed opening movement.

3. In the combination according to claim 1, said reciprocating means comprising pressure actuated means in communication with said manifold.

4. In the combination according to claim 3, said pressure actuated means being in communication with said inlet manifold at a location downstream of said throttle means for actuation with decreasing inlet manifold pressure at said location to move said reciprocating means in said one direction.

5. In the combination according to claim 4, the communication between said pressure actuated means and inlet manifold including valve means shiftable to an inoperative position for disconnecting said inlet manifold from said pressure actuated means, a vacuum accumulator, one-way flow control means connecting said accumulator with said inlet manifold to enable gas flow only from said accumulator, said valve means having means in said inoperative position for connecting said accumulator with said pressure actuated means to subject the latter to the pressure in said accumulator.

6. In the combination according to claim 5, said valve means being shiftable to an operative position and having means at said operative position for connecting said inlet manifold pressure with said pressure actuated means, and electrical solenoid means for selectively shifting said valve means to and from said operative and inoperative positions.

7. In the combination according to claim 5, means for selectively shifting said valve means between an operative and said inoperative position.

8. In the combination according to claim 7, said means for selectively shifting said valve means comprising a second pressure actuated means, conduit means for connecting said second pressure actuated means with said inlet manifold pressure, second valve means in said conduit means selectively operable for disconnecting said second pressure actuated means from said inlet manifold pressure and for simultaneously connecting said second pressure actuated means to atmosphere, and means operable in response to actuation of said second pressure actuated means to shift the first named valve means to said inoperative position when said second pressure actuated means is connected to atmosphere by said second valve means.

* * * * *